US007866582B2

(12) United States Patent
Nied

(10) Patent No.: US 7,866,582 B2
(45) Date of Patent: Jan. 11, 2011

(54) METHOD FOR GENERATING FINEST PARTICLES AND JET MILL THEREFOR AS WELL AS CLASSIFIER AND OPERATING METHOD THEREOF

(75) Inventor: Roland Nied, Raiffeisen-Strasse 10, 86486 Bonstetten (DE)

(73) Assignees: Netzsch-Condux Mahltechnik GmbH (DE); Roland Nied (DE)

( * ) Notice: Subject to any disclaimer, the term of this patent is extended or adjusted under 35 U.S.C. 154(b) by 0 days.

(21) Appl. No.: 12/425,136

(22) Filed: Apr. 16, 2009

(65) Prior Publication Data

US 2009/0236451 A1 Sep. 24, 2009

Related U.S. Application Data

(63) Continuation of application No. PCT/DE2007/001851, filed on Oct. 16, 2007.

(30) Foreign Application Priority Data

Oct. 16, 2006 (DE) ..... 10 2006 048 865

(51) Int. Cl.
*B02C 19/00* (2006.01)
*B02C 19/06* (2006.01)

(52) U.S. Cl. ..... 241/5; 241/39

(58) Field of Classification Search ..... 241/5, 241/23, 39, 40, 65, 47
See application file for complete search history.

(56) References Cited

U.S. PATENT DOCUMENTS 7,681,814 B2 * 3/2010 Krebs et al. ..... 241/39

FOREIGN PATENT DOCUMENTS

DE 19824062 A1 12/1999
EP 0472930 A2 3/1992
EP 1080786 A1 3/2001

OTHER PUBLICATIONS

International Preliminary Report on Patentability & Written Opinion of the International Searching Authority; PCT/DE2007/001851; Jun. 10, 2009; 10 pages.

International Search Report; PCT/DE2007/001851; Feb. 15, 2008; 2 pages.

Iler R. K., "The chemistry of Silica", 1979, ISBN 0-471-02404-X, Fig. 3.25 pp. 231-233.

Iler R. K., "The chemistry of Silica", 1979, ISBN 0-471-02404-X, Chapter 5, p. 462.

* cited by examiner

*Primary Examiner*—Faye Francis
(74) *Attorney, Agent, or Firm*—St. Onge Steward Johnston & Reens LLC

(57) ABSTRACT

A method and apparatus for generating fine particles via a jet mill with an integrated dynamic air classifier, wherein the rotational speed of a classifying rotor of the air classifier and the inner amplification ratio V (=Di/DF) are so selected, set or controlled that the circumferential velocity of the operating medium at an immersion pipe or outlet connection assigned to the classifying wheel reaches up to 0.8 times of the velocity of sound of the operating medium. A dynamic air classifier with a classifying wheel is additionally created, wherein a source for an operating medium is a fluid, more preferably a gas or a vapour, which has a higher and more preferably a substantially higher velocity of sound than air.

5 Claims, 2 Drawing Sheets

METHOD FOR GENERATING FINEST PARTICLES AND JET MILL THEREFOR AS WELL AS CLASSIFIER AND OPERATING METHOD THEREOF

CROSS-REFERENCE TO RELATED APPLICATIONS

The present application is a continuation of pending International patent application PCT/DE2007/001851 filed on Oct. 16, 2007 which designates the United States and claims priority from German patent application DE 10 2006 048 865.2 filed on Oct. 16, 2006, the content of which is incorporated herein by reference.

FIELD OF THE INVENTION

The present invention relates to a method for generating fine particles by means of a jet mill with an integrated dynamic air classifier and a jet mill with such an air classifier as well as an air classifier and an operating method thereof.

BACKGROUND OF THE INVENTION

The material to be classified or to be comminuted consists of coarser and finer particles which are carried along in an airflow and form the product flow which is introduced in to a housing of an air classifier of the jet mill. The product flow in radial direction enters a classifying wheel of the air classifier. In the classifying wheel the coarser particles are separated from the airflow and the airflow axially leaves the classifying wheel with the fine particles through an outflow pipe. The airflow with the particles to be filtered out or produced can then be fed to a filter in which a fluid, such as for example air, and fine particles are separated from each other.

From DE 198 24 062 A1 such a jet mill is known in the comminution chamber of which at least one energy-rich comminution jet of superheated steam is additionally introduced with high flow energy, wherein the comminution chamber except for the inlet device for the at least one comminution jet comprises an inlet for the material to be comminuted and an outlet for the product, and wherein in the region of the meeting of material to be comminuted and at least one comminution jet of superheated steam and material to be comminuted have at least approximately the same temperature.

Furthermore, a corresponding air classifier more preferably for a jet mill is know for instance from EP 0 472 930 B1. This air classifier and its operating method are extremely satisfying in principle.

It is therefore the objective of the present invention to further optimise a method for generating finest particles by means of a jet mill and a jet mill with an air classifier integrated therein.

SUMMARY OF THE INVENTION

This objective is achieved with a method for generating fine particles by means of a jet mill with an integrated dynamic air classifier, wherein the jet mill may be a fluidized bed jet mill or a high-density bed jet mill.

Accordingly, a generic method for generating finest particles by means of a jet mill with an integrated dynamic air classifier is characterized in that the speed of a classifying rotor of the air classifier and the inner amplification ratio R (=Di/DF) are so selected, set or controlled that the circumferential velocity of an operating medium at an immersion pipe or outlet connection associated with the classifying wheel reaches up to 0.8 times the velocity of sound of the operating medium.

As preferred embodiment it is seen that the rotational speed of a classifying rotor of the air classifier and the inner amplification ratio R (=Di/DF) are so selected, set or controlled that the circumferential velocity of the operating medium at the immersion pipe or outlet connection reaches up to 0.7 times and preferentially up to 0.6 times the velocity of sound of the operating medium.

Yet a further advantageous embodiment consists in that as operating medium a fluid, more preferably gases or vapours, is used that has a high and more preferably substantially higher velocity of sound than air (343 m/s).

It is particularly preferred when as operating medium a fluid, more preferably gases or vapours, is used which has a velocity of sound of at least 450 m/s.

It is further an advantage when as the operating medium, steam, hydrogen gas or helium gas is used.

As indicated above, a jet mill with an integrated dynamic air classifier for generating finest particles is additionally created through the invention, wherein the rotational speed of a classifying rotor of the air classifier and the inner amplification ratio R (=Di/DF) can be so selected or set or controlled that the circumferential velocity of the operating medium (B) at an immersion tube or outlet connection associated with the classifying wheel reaches up to 0.8 times the velocity of sound of the operating medium.

This can be further developed in that the rotational speed of a classifying rotor of the air classifier and the inner amplification ratio R (=Di/DF) can be so selected or set or controlled that the circumferential velocity of the operating medium B) at the immersion tube or outlet connection reaches up to 0.7 times and particularly preferred up to 0.6 times the velocity of sound of the operating medium.

Another further development can consist in that a source for an operating medium is included or associated which has a higher and more preferably substantially higher velocity of sound than air (343 m/s).

With particular preference it is further provided that a source for an operating medium is included or associated which has a velocity of sound of at least 450 m/s.

In addition it is particularly advantageous if a source for an operating medium is included or associated which contains gases or vapours, wherein more preferably a source for an operating medium is included or associated that contains steam, hydrogen gas or helium gas.

Beyond this it can be advantageously provided that the jet mill is a fluidized bed jet mill or a high-density bed jet mill.

Yet a further advantageous embodiment more preferably with steam as operating medium consists in that comminution or inlet nozzles are provided which are connected to a steam supply line that is equipped with expansion bends, i.e. when the steam supply line is connected to a steam source.

Likewise in connection with an embodiment for the use of steam as operating medium it is particularly advantageous if the surface of the jet mill according to the invention has as small as possible a value.

It is furthermore advantageous if the flow paths are at least largely free of protrusions and/or if the components of the jet mill are designed to avoid mass agglomerations.

Again particularly in combination with an embodiment for the use of steam as operating medium it is advantageous if the components of the jet mill are designed to avoid condensation. More preferably suitable preferential devices for the avoidance of condensation can be included.

More preferably it can be advantageously provided that the classifying rotor has a clear height that increases with decreasing radius, wherein preferentially the area of the classifying rotor subjected to the through-flow is at least approximately constant. Alternatively or additionally it can be advantageously provided that the classifying rotor comprises a replaceable co-rotating immersion pipe. With yet a further version it is preferred if a fine material outlet chamber is provided which in flow direction comprises a widened cross section.

Furthermore the jet mill according to the invention can advantageously include an air classifier which includes individual features or feature combinations of the air classifier according to EP 0 472 930 B1. By making this reference the entire disclosure content of EP 0 472 930 B1 is included here in its full extent to avoid mere identical adoption. More preferably the air classifier can include means for the removal of the circumferential components of the flow according to EP 0 472 930 B1. Here it can be more preferably provided that an outlet connection associated with the classifying wheel of the air classifier which is embodied as immersion pipe comprises a widened cross section that is embodied rounded preferentially to avoid the formation of swirls.

Through the invention a dynamic air classifier with a classifying wheel is additionally created wherein a source for an operating medium is associated that has a higher velocity of sound than air (343 m/s).

Preferentially a source for an operating medium is associated that has a substantially higher velocity of sound than air (343 m/s) and/or a source for an operating medium (B) is associated which has a velocity of sound of at least 450 m/s. A further preferential embodiment of the dynamic air classifier consists in that a source for an operating medium is associated which includes gases or vapours, more preferably steam, hydrogen gas or helium gas.

Yet a further preferred embodiment of the dynamic air classifier consists in that a classifying rotor or classifying wheel is included which has a clear height that increases with decreasing radius. Alternatively or additionally it can be provided that the area of the classifying rotor or wheel subjected to the through-flow is at least approximately constant and/or that a classifying rotor or classifying wheel is included which comprises a replaceable, co-rotating immersion pipe.

It can be further provided that a fine material outlet chamber is provided which in flow direction comprises a widened cross section and/or that the flow paths are at least largely free of protrusions.

The dynamic air classifier can additionally be further embodied in that the rotational speed of the classifying rotor or classifying wheel of the air classifier and the inner amplification ratio R (=Di/DF) can be so selected or set or controlled that the circumferential velocity of the operating medium at an immersion pipe or outlet connection associated with the classifying wheel reaches up to 0.8 times, more preferably up to 0.7 times and preferentially up to 0.6 times the velocity of sound of the operating medium.

With an additionally created operating method for an air classifier with a classifying rotor or classifying wheel it is provided that as operating medium a fluid, more preferably gases or vapours, is used which has a higher and more preferably substantially higher velocity of sound than air (343 m/s).

Here it is preferred if as operating medium a fluid, more preferably gases or vapours, is used which has a substantially higher velocity of sound than air (343 m/s) and/or if as operating medium a fluid, more preferably gases or vapours, is used which has a velocity of sound of at least 450 m/s. Furthermore, steam, hydrogen gas or helium gas is preferentially used as operating medium.

Another preferential embodiment of the operating method for an air classifier consists in that the rotational speed of the classifying rotor or classifying wheel and the inner amplification ratio V (=Di/DF) are so selected, set or controlled that the circumferential velocity of the operating medium at an immersion pipe or outlet connection associated with the classifying wheel reaches up to 0.8 times, more preferably up to 0.7 times and preferentially up to 0.6 times the velocity of sound of the operating medium.

Generally and in special configurations the method is embodied in a comminution system (comminution apparatus), preferably in a comminution system comprising a jet mill, particularly preferably comprising a counterflow jet mill. To this end, a charge material to be reduced is accelerated in expanding gas jets of high velocity and reduced through particle-particle impacts. As jet mills, very particularly preferred is the use of fluidized bed counterflow jet mills or high-density bed jet mills or spiral jet mills. In the case of the very particularly preferred fluidized bed counterflow jet mill there are located in the lower third of the comminution chamber two or more comminution jet inlets, preferably in form of comminution nozzles, which are preferably located in a horizontal plane. The comminution jet inlets are particularly preferably arranged on the circumference of the preferably round mill vessel so that the comminution jets all meet at a point in the interior of the comminution vessel. More preferably preferred the comminution jet inlets are evenly distributed over the circumference of the comminution vessel. In the case of three comminution jet inlets the spacing would thus amount to 120°each.

In a special embodiment of the method according to the invention the comminution system (comminution apparatus) comprises a classifier, preferentially a dynamic classifier, particularly preferably a dynamic bucket wheel classifier or a classifier according to FIGS. 2 and 3. This dynamic air classifier contains a classifying wheel and a classifying wheel shaft as well as a classifier housing, wherein between the classifying wheel and the classifier housing a classifier gap and between the classifying wheel shaft and the classifier housing a shaft passage is formed and characterized in that gap flushing of classifier gap and/or shaft passage with compressed gases of low energy takes place.

By using a classifier combined with the jet mill operated under the conditions according to the invention the oversize grain is limited, wherein the product particles jointly rising with the expanded gas jets are directed out of the centre of the comminution vessel through the classifier and subsequently the product which has adequate fineness is discharged from the classifier and from the mill. Particles that are too coarse are returned into the comminution zone and subjected to further reduction.

In the comminution system a classifier can be connected downstream of the mill as separate unit, but an integrated classifier is preferably used.

A further possible feature of the method according to the invention consists in that a heating-up phase is connected upstream of the actual comminution step in which it is ensured that the comminution chamber, particularly preferably all substantial components of the mill and/or of the comminution system on which water and/or steam could condense, is/are heated up in such a manner that its/their temperature is above the dew point of the steam. In principle, heating-up can be performed through any heating method. However, heating is preferably performed in that hot gas is directed through the mill and/or the entire comminution system so that the temperature of the gas at the mill outlet is higher than the dew point of the steam. Here it is particularly preferably ensured that the hot gas adequately heats up all substantial components of the mill and/or of the entire comminution system that come in contact with the steam.

Principally, any gas and/or gas mixtures can be used as heating gas, however hot air and/or combustion gases and/or inert gases are preferably used. Preferentially the temperature of the hot gas is above the dew point of the steam. Principally the hot gas can be introduced in the comminution chamber in any manner. Preferentially inlets or nozzles are located in the comminution chamber for this purpose. These inlets or nozzles can be the same inlets or nozzles through which during the comminution phase the comminution jets are directed (comminution nozzles). However, it is also possible that separate inlets or nozzles (heating nozzles) are present in the comminution chamber through which the hot gas and/or gas mixture can be introduced. In a preferred embodiment the heating gas or heating gas mixture is introduced through at least two, preferably three or more inlets or nozzles arranged in a plane, which are so arranged on the circumference of the preferably round mill vessel that the jets all meet in one point in the interior of the comminution vessel. More preferably preferred the inlets or nozzles are evenly distributed over the circumference of the comminution vessel.

During the comminution, a gas and/or a vapour, more preferably steam and/or a gas/steam mixture is expanded through the comminution jet inlets, preferably in form of comminution nozzles. This operating medium as a rule comprises a substantially higher velocity of sound than air (343 m/s), preferably at least 450 m/s. Advantageously the operating medium comprises steam and/or hydrogen gas and/or argon and helium. Particularly preferably it is superheated steam. In order to achieve very fine comminution it has proved to be particularly advantageous that the operating medium with a pressure of 15 to 250 bar, particularly preferably of 20 to 150 bar, very particularly preferred 30 to 70 bar and more preferably preferred 40 to 65 is expanded in the mill. Likewise particularly preferably the operating medium has a temperature of 200 to 800° C., particularly preferably 250 to 600° C. and more preferably 300 to 400° C.

Further preferred and/or advantageous configurations of the invention are obtained from the entire application and documents available.

BRIEF DESCRIPTION OF THE DRAWINGS

In the following the invention is explained in more detail merely exemplarily by means of exemplary embodiments making reference to the drawings, in which.

DETAILED DESCRIPTION OF THE INVENTION

Figure 1:
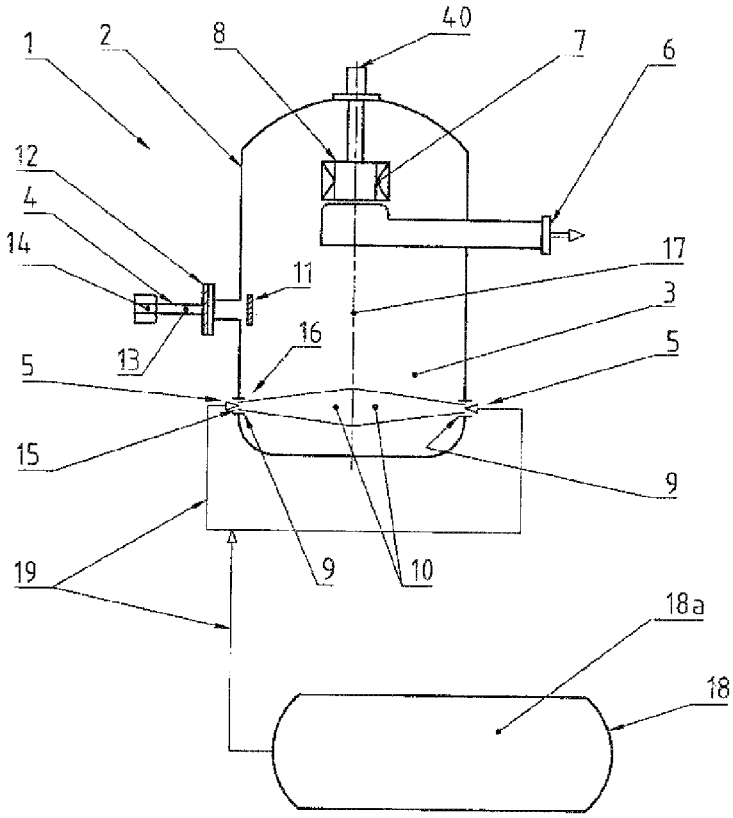
FIG. 1 shows diagram-like an exemplary embodiment of a jet mill in a part-section schematic drawing.

By means of the embodiment and application examples described in the following and presented in the drawings the invention is merely explained in more detail exemplarily, i.e. it is not restricted to these exemplary embodiments and applications or to the respective feature combinations within individual exemplary embodiments and exemplary applications. Methods and device features in each case are similarly also obtained from device and method descriptions.

Individual features which state and/or are shown in connection with concrete exemplary embodiments are not limited to these exemplary embodiments or the combination with the remaining features of these exemplary embodiments but can be combined within the scope of what is technically possible with any other variants even if these are not separately covered in the present documents.

Identical reference symbols in the individual figures and images of the drawings designate identical or similar or identically or similarly acting components. By means of the presentations in the drawing features which are not provided with reference symbols also become clear regardless of whether such features are described in the following or not. On the other hand features, which are included in the present description but are not visible or shown in the drawing, are easily understandable to a person skilled in the art.

FIG. 1 shows an exemplary embodiment of a jet mill 1 with a cylindrical housing 2 enclosing a comminution chamber 3, a comminution stock feeder 4 approximately at half the height of the comminution chamber 3, at least one comminution jet inlet 5 in the lower region of the comminution chamber 3 and a product outlet 6 in the upper region of the comminution chamber 3. There an air classifier 7 is arranged with a rotatable classifying wheel 8 with which the comminution stock (not shown) is classified in order to only discharge comminution stock below a certain grain size through the product outlet 6 out of the comminution chamber 3 and feed comminution stock with a grain size above the selected value to a further comminution process.

The classifying wheel 8 of air classifiers can be a conventional classifying wheel whose vanes (see later for example in connection with FIG. 3) limit radially orientated vane channels at whose outer ends the classifying air enters and drags particles of lesser grain size or mass along to the central outlet and to the product outlet 6, while larger particles or particles of greater mass are rejected under the effect of centrifugal force. More preferably the air classifier 7 and/or at least its classifying wheel 8 are equipped with at least one embodiment feature according to EP 0 472 930 B1.

Only one comminution jet inlet 5 for example consisting of a single radially directed inlet opening or inlet nozzle 9 can be provided in order to let a single comminution jet 10 strike the comminution stock particles which from the comminution stock feeder 4 reach the region of the comminution jet 10 with high energy and have the comminution stock particles break up into smaller part-particles which are sucked in by the classifying wheel 8 and, insofar as they have a correspondingly small size or mass, are transported to the outside through the product outlet 6. A better effect however is achieved with comminution jet inlets 5 in pairs that are located diametrically opposite each other, which form two comminution jets 10 that collide with each other which more intensively bring about the breaking-up of the particles than is possible with only one comminution jet 10, more preferably if a plurality of comminution jet pairs is generated.

Preferably two or more comminution jet inlets, preferentially comminution nozzles, more preferably 3, 4, 5, 6, 7, 8, 9, 10, 11 or 12 comminution jet inlets are used which are attached in the lower third of the more preferably cylinder-shaped housing of the comminution chamber. These comminution jet inlets are ideally arranged in a plane and evenly distributed over the circumference of the comminution vessel, so that the comminution jets all meet at a point in the interior of the comminution vessel. Furthermore, the inlets or nozzles are preferably distributed evenly over the circumference of the comminution vessel. With three comminution jets this would be an angle of 120° between the respective inlets or nozzles. In general it can be said that the larger the comminution chamber the more inlets or comminution nozzles are used.

In a preferred embodiment of the method according to the invention the comminution chamber can include heating openings 5*a*, preferably in form of heating nozzles, in addition to the comminution jet inlets through which heating nozzles the hot gas can be directed into the mill during the heating-up phase. As already explained above, these nozzles or openings can be arranged in the same plane as the comminution openings or nozzles 5. One, but preferably also a plurality, particularly preferably 2, 3, 4, 5, 6, 7 or 8 heating openings or nozzles 5*a* can be included.

In a very particularly preferred embodiment the mill includes two heating nozzles or heating openings and three comminution nozzles or comminution openings.

Furthermore, the processing temperature for example can be influenced through the use of an internal heating source 11 between comminution stock feeder 4 and the region of the comminution jets 10 or a suitable heating source 12 in the region outside the comminution stock feeder 4 or through the processing of particles of a comminution stock that is already warm anyhow, which subject to the avoidance of heat losses enters the comminution stock feeder 4, for which a feed pipe 13 is surrounded by a temperature-insulated jacket 14. The heating source 11 or 12, if employed, can basically be any and thus suitable for the purpose and be selected in accordance with the availability on the market so that further explanations in this regard are not required.

For the temperature, the temperature of the comminution jet or the comminution jets 10 is more preferably relevant and the temperature of the comminution stock should at least approximately correspond to this comminution jet temperature.

To form the comminution jets 10 introduced into the comminution chamber 3 through comminution jet inlets 5 superheated steam is used in the present exemplary embodiment. Here it must be assumed that the heat content of the steam after the inlet nozzle 9 of the respective comminution jet inlet 5 is not substantially smaller than before this inlet nozzle 9. Since the energy necessary for the collision reduction is to be available primarily as flow energy, the pressure drop between the inlet 15 of the inlet nozzle 9 and its outlet 16 will by contrast be significant (the pressure energy is largely converted into flow energy) and the temperature drop will not be insignificant either. More preferably this temperature drop is to be compensated through the heating of the comminution stock to the extent that comminution stock and comminution jet 10 in the region of the centre 17 of the comminution chamber 3 with at least two comminution jets 10 meeting each other or a multiple of two comminution jets 10 have the same temperature.

To configure and carry out the processing of the comminution jet 10 of superheated steam more preferably in form of a closed system reference is made to DE 198 24 062 A1 whose complete disclosure content is herein included in full in this regard to avoid mere identical adoption through the present reference. Through the closed system for example comminution of hot slag as comminution stock is possible with optimal efficiency.

The presentation of the present exemplary embodiment of the jet mill 1 representatively for any feed of an operating medium B shows a reservoir or generation device 18 such as for example a tank 18*a*, from which the operating medium B is directed via line devices 19 to the comminution jet inlet 5 of the comminution jet inlets 5 for forming the comminution jet 10 or the comminution jets 10.

More preferably based on a jet mill 1 equipped with an air classifier 7 of this kind, wherein the exemplary embodiments in this regard are to be understood only exemplarily and not intended as being restrictive, a method for generating finest particles is carried out with this jet mill 1 with an integrated dynamic air classifier 7. The innovation compared with conventional jet mills here consists in that the rotational speed of the classifying rotor or classifying wheel 8 of the air classifier 7 and the inner amplification ratio V (=Di/DF) are so selected, set or controlled that the circumferential velocity of an operating medium B at an immersion pipe or outlet connection 20 associated with the classifying wheel 8 reaches up to 0.8 times, preferentially up to 0.7 times and particularly preferably up to 0.6 times the velocity of sound of the operating medium B.

Making reference to the version with superheated steam as operating medium B or as alternative thereto it is particularly advantageous to use gases or vapours B as operating medium which have a higher and more preferably substantially higher velocity of sound than air (343 m/s). Especially gases or vapours B which have a velocity of sound of at least 450 m/s are used as operating medium. This clearly improves the generation and the yield of finest particles compared with methods using other operating media as according to knowledge from practice are conventionally employed, and thus the method as a whole optimised.

As operating medium B a fluid is used, preferably the already mentioned steam but also hydrogen gas or helium gas.

With respect to the device the jet mill 1, which is more preferably a fluidized bed jet mill or a high-density bed jet mill, is so configured or designed with the integrated dynamic air classifier 7 for the generation of finest particles or provided with suitable devices that the rotational speed of the classifying rotor or classifying wheel 8 of the air classifier 7 and the inner amplification ratio V (=Di/DF) are so selected or set or regulatable or controllable that the circumferential velocity of the operating medium B at the immersion pipe or outlet connection 20 reaches up to 0.8 times preferentially up to 0.7 times and particularly preferably up to 0.6 times the velocity of sound of the operating medium B.

Furthermore the jet mill 1 is equipped with a source, such as for example the reservoir or generation device 18 for steam or superheated steam or another suitable reservoir or generation device for an operating medium B or such an operating medium source is associated with said jet mill, out of which for operating an operating medium B with a higher and more preferably substantially higher velocity of sound than air (343 m/s) such as preferentially a velocity of sound of at least 450 m/s is fed in. This operating medium source, such as for example the reservoir or generation device 18 for steam or superheated steam contains gases or vapours B for use in the operation of the jet mill 1, namely more preferably the steam already mentioned above, while hydrogen gas or helium gas also constitute preferred alternatives.

More preferably when using superheated steam as operating medium B it is advantageous to provide line devices 19 equipped with expansion bends (not shown) to the inlet or comminution nozzles 9 which then must also be designated as steam feed line, i.e. preferentially if the steam feed line is connected to a steam source as reservoir or generation device 18.

A further advantageous aspect when using steam as operating medium B consists in providing the jet mill 1 with as small as possible a surface area or in other words, optimising the jet mill 1 with regard to as small as possible a surface area. Especially in connection with the steam as operating medium B it is particularly advantageous to avoid heat exchange or heat loss and thus energy loss in the system. This purpose is also served by the additional alternative or additional configuration measure, namely to design the components of the jet mill 1 to avoid mass agglomerations or optimise said mill to that effect. This can for example be realised by using preferably thin flanges in the and to the connection of the line devices 19.

Energy loss and also other flow-relevant impairments can further be included or avoided if the components of the jet mill 1 are designed or optimised to avoid condensation. Even special devices (not shown) for avoiding condensation can be included for this purpose. Furthermore it is an advantage if the flow paths are at least largely free of protrusions or optimised to that effect. In other words, the principle to avoid as much as possible or everything that can become cold and where condensation can thus occur is implemented with these embodiment versions individually or in any combinations.

It is furthermore advantageous and therefore preferred if the classifying rotor comprises a clear height that increases with decreasing radius, i.e. increases towards its axis, wherein more preferably the area of the classifying rotor subjected to the through-flow is at least approximately constant. Additionally or alternatively a fine material outlet chamber can be provided which in flow direction comprises a widened cross section.

A particularly preferred embodiment with the jet mill 1 consists in that the classifying rotor 8 comprises a replaceable, co-rotating immersion pipe 20.

Merely to explain and deepen the overall understanding the particles to be generated from the material to be preferentially processed is additionally discussed in the following. For example it is amorphous $SiO_2$ or other amorphous chemical products which are reduced with the jet mill. Further materials are silicic acids, silicic gels of silicates.

Generally, the method and the devices to be used and embodied for this according to the invention relate to powdery amorphous or crystalline solids with a very small mean particle size and a narrow particle size distribution, a method for their production, as well as their use.

Fine, amorphous silicic acid and silicates have been manufactured industrially for decades. It is known that the achievable particle diameter is proportional to the root of the reciprocal of the impact velocity of the particles. The impact velocity in turn is determined by the expanding gas jets of the respective comminution medium from the nozzles used. For this reason for generating very small particle sizes superheated steam can be preferably used since the acceleration capacity of steam is approximately 50% greater than that of air. The use of steam however has the advantage that more preferably during the start-up of the mill condensation can occur throughout the comminution system, which as a rule results in the formation of agglomerates and crusts during the comminution process.

The mean particle diameters $d_{50}$ that are achieved when using conventional jet mills for the comminution of amorphous silicic acid, silicates or silica gels were thus clearly above 1 μm in the past.

Furthermore, the particles after the treatment with previous methods and devices according to the prior art have a wide particle size distribution with particle diameters for example from 0.1 to 5.5 μm and a share of particles>2 μm of 15 to 20%. A high share of large particles, i.e. >2 μm is disadvantageous for applications in coating systems since because of this no thin layers with smooth surface can be produced. In contrast with this it is possible with the method according to the invention and the appropriate devices to grind solids to a mean particle size $d_{50}$ of smaller than 1.5 μm and additionally achieve a very close particle distribution. More preferably amorphous or crystalline solids with a mean particle size $d_{50}$<1.5 μm and/or a $d_{90}$-value<2 μm and/or a $d_{99}$-value<2 μm can thus be achieved.

Amorphous solids can be gels but also such with a structure of a different type such as for example particles of agglomerates and/or aggregates. Preferably it concerns solids containing or consisting of at least one metal and/or at least one metal oxide, more preferably amorphous oxides of metals of the 3rd and 4th main group of the periodic system of the elements. This applies both to the gels as well as also to the other remaining amorphous solids, more preferably such containing particles of agglomerates and/or aggregates. Particularly preferred are precipitated silicic acids, pyrogenic silicic acids, silicates and silica gels, wherein silica gels comprise hydrogels, aerogels as well as xerogels. Amorphous solids of this kind generally with a mean particle size $d_{50}$<1.5 μm and/or a $d_{90}$-value<2 μm and/or a $d_{99}$-value<2 μm are for instance used in surface coating systems.

Compared with the method of the prior art, more preferably the wet comminution, the method according to the invention has the advantage that it is a dry comminution method, which directly results in powdery products with very small mean particle size, which particularly advantageously can also have a high porosity. The problem of re-agglomeration during drying is obsolete since no drying step connected downstream of comminution is necessary. A further advantage of the method according to the invention in one of its preferred embodiments must be seen in that the comminution can take place simultaneously with the drying, so that for example a filter cake can be directly further processed. This saves an additional drying step and simultaneously increases the space-time yield. In its preferred embodiments the method according to the invention additionally has the advantage that when running up the comminution system, none or only very small quantities of condensate develop in the comminution system, more preferably in the mill. Dried gas can be used during cooling. Consequently no condensate develops in the comminution system even during cooling and the cooling-down phase is significantly shortened. The effective machine operating times can thus be increased. Finally, because no or only very little condensate is formed during the start-up in the comminution system it is prevented that already dried comminution stock becomes wet again, as a result of which the formation of agglomerates and crusts during the comminution process can be prevented.

The amorphous powdery solids produced by means of the method according to the invention have particularly good characteristics for use in surface coating systems, for example as rheology aid, in paper coating and in paints or varnishes because of the very special and unique mean particle sizes and particle size distributions. The products thus obtained allow it for instance because of the very small mean particle size and more preferably the low $d_{90}$-value and $d_{99}$-value to produce very thin coatings.

The terms powder and powdery solids are used synonymously within the context of the present invention and each describe finely reduced solid substances of small dry particles, wherein dry particles in this context means that it concerns particles which are externally dry. Although these particles generally have a water content, this water is however strongly bonded to the particles or in their capillaries so that it is not released at room temperature and at atmospheric pressure. In other words it concerns particulate substances discernable with optical methods and not suspensions or dispersions. Furthermore it can concern both surface-modified as well as non surface-modified solids. The surface modification preferably is performed with coating agents containing carbon and can take place both before as well as after comminution.

The solids according to the invention can be present as gel or as particles containing agglomerates and/or aggregates. Gel means that the solids are built up of a solid, three-dimensional preferably homogenous network of primary particles. Examples of this are for instance silica gels.

Particles containing aggregates and/or agglomerates in terms of the present invention have no three-dimensional network or at least no network of primary particles that extends over the entire particle. Instead they have aggregates and agglomerates of primary particles. Examples of this are precipitation silicic acids and pyrogenic silicic acids.

A description of the structural difference of silica gels compared with precipitated SiO2 can be found in Iler R. K., "The chemistry of Silica", 1979, ISBN 471-02404-X, Chapter 5, Page 462 as well as in Figure 3.25 there. The content of this publication is herewith expressly included in the description of this invention.

With the technology according to the invention any particles, more preferably amorphous particles can be comminuted in such a manner that powdery solids with a mean particle size $d_{50}$<1.5 μm and/or a $d_{99}$-value<2 μm and/or a $d_{99}$-value<2 μm are obtained. It is more preferably possible to achieve these particle sizes and particle size distributions via dry comminution.

Such more preferably amorphous solids are characterized in that they have a mean particle size (TEM) $d_{50}$<1.5 μm, preferably $d_{50}$<1 μm, particularly preferably $d_{50}$ from 0.01 to 1 μm, very particularly preferred $d_{50}$ of 0.05 to 0.9 μm, more preferably preferred $d_{50}$ of 0.05 to 0.8 μm, specially preferred of 0.05 to 0.5 μm and very specially preferred of 0.08 to 0.25 μm, and/or a $d_{90}$-value<2 μm, preferably $d_{90}$<1.8 μm, particularly preferred $d_{90}$ from 0.1 to 1.5 μm, very particularly preferred $d_{90}$ from 0.1 to 1.0 μm and more preferably preferred $d_{90}$ of 0.1 to 0.5 μm, and/or a $d_{99}$-value<2 μm, preferably $d_{99}$<1.8 μm, particularly preferred $d_{99}$<1.5 μm, very particularly preferred $d_{99}$ from 0.1 to 1.0 μm and more preferably preferred $d_{99}$ from 0.25 to 1.0 μm. All aforementioned particle sizes refer to the particle size determination by means of TEM analysis and image evaluation.

These solids can be gels but also other kinds of amorphous or crystalline solids. Preferably it concerns solids containing or consisting of at least a metal and/or metal oxide, more preferably amorphous oxides of metals of the third and fourth main group of the periodic system of the elements. This applies both to the gels as well as to the amorphous or crystalline solids with a structure of a different type. Particularly preferred are precipitated silicic acids, pyrogenic silicic acids, silicates and silica gels, wherein silica gels comprise both hydro as well as aero and xerogels.

First special embodiments of the solids concerned are particulate solids containing aggregates and/or agglomerates, here more preferably precipitated silicic acids and/or pyrogenic silicic acid and/or silicates and/or mixtures thereof, with a mean particle size $d_{50}$<1.5 μm, preferably $d_{50}$<1 μm, particularly preferred $d_{50}$ of 0.01 to 1 μm, very particularly preferred $d_{50}$ from 0.05 to 0.9 μm, more preferably preferred $d_{50}$ from 0.05 to 0.8 μm, specially preferred from 0.05 to 0.5 μm and very specially preferred from 0.1 to 0.25 μm, and/or a $d_{90}$-value<2 μm, preferably $d_{90}$<1.8 μm, particularly preferred $d_{90}$ from 0.1 to 1.5 μm, very particularly preferred $d_{90}$ from 0.1 to 1.0 μm, more preferably preferred $d_{90}$ from 0.1 to 0.5 μm and specially preferred $d_{90}$ from 0.2 to 0.4 μm, and/or a $d_{99}$-value<2 μm, preferably $d_{99}$<1.8 μm, particularly preferred $d_{99}$<1.5 μm, very particularly preferred $d_{99}$ from 0.1 to 1.0 μm, more preferably preferred $d_{99}$ from 0.25 to 1.0 μm and specially preferred $d_{99}$ from 0.25 to 0.8. Very particularly preferred here are precipitated silicic acids since these are substantially more cost-effective compared with pyrogenic silicic acids. All particle sizes mentioned above refer to the particle size determination by means of TEM—(Transmission electron microscopy) Analysis and Image Evaluation.

In a second special embodiment the solids concern gels, preferably silica gels, more preferably xerogels or aerogels with a mean particle size $d_{50}$<1.5 μm, preferably $d_{50}$<1 μm, particularly preferably $d_{50}$ of 0.01 to 1 μm, very particularly preferred $d_{50}$ of 0.05 to 0.9 μm, more preferably preferred $d_{50}$ of 0.05 to 0.8 μm, specially preferred of 0.05 to 0.5 μm and very specially preferred of 0.1 to 0.25 μm, and/or a $d_{90}$-value<2 μm, preferably $d_{90}$ 0.05 to 1.8 μm, particularly preferably $d_{90}$ of 0.1 to 1.5 μm, very particularly preferred $d_{90}$ of 0.1 to 1.0 μm, more preferably preferred $d_{90}$ of 0.1 to 0.5 μm and specially preferred $d_{90}$ of 0.2 to 0.4, and/or a $d_{99}$-value<2 μm, preferably $d_{99}$<1.8 μm, particularly preferred $d_{99}$ 0.05 to 1.5 μm, very particularly preferred $d_{99}$ from 0.1 to 1.0 μm, more preferably preferred $d_{99}$ from 0.25 to 1.0 μm and specially preferred $d_{99}$ from 0.25 to 0.8. All mentioned particle sizes relate to the particle size determination by means of TEM-Analysis and Image Evaluation.

In yet another even more special embodiment it concerns a close-porous xerogel which in addition to the $d_{50}$, $d_{90}$ and $d_{99}$ values included in the exemplary embodiments explained immediately above, additionally has a pore volume of 0.2 to 0.7 ml/g, preferably 0.3 to 0.4 ml/g. A further alternative embodiment relates to a xerogel which in addition to the $d_{50}$, $d_{90}$ and $d_{99}$-values already included in connection with the second type of exemplary embodiments has a pore volume of 0.8 to 1.4 ml/g, preferably 0.9 to 1.2 ml/g. With yet a further alternative within the context of the second group of exemplary embodiments explained above it relates to a xerogel which in addition to the already stated $d_{50}$, $d_{90}$ and $d_{99}$-values has a pore volume of 1.5 to 2.1 ml/g, preferably 1.7 to 1.9 ml/g.

Figure 3:
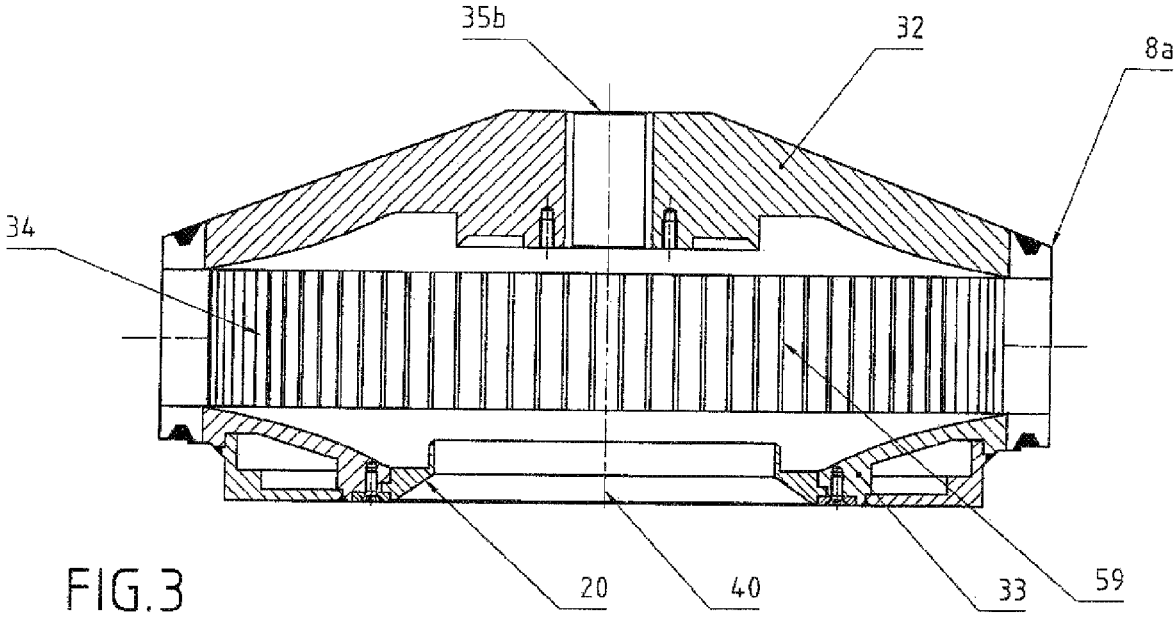
FIG. 3 shows in schematic view and as vertical section a classifying wheel of an air classifier.
Figure 2:
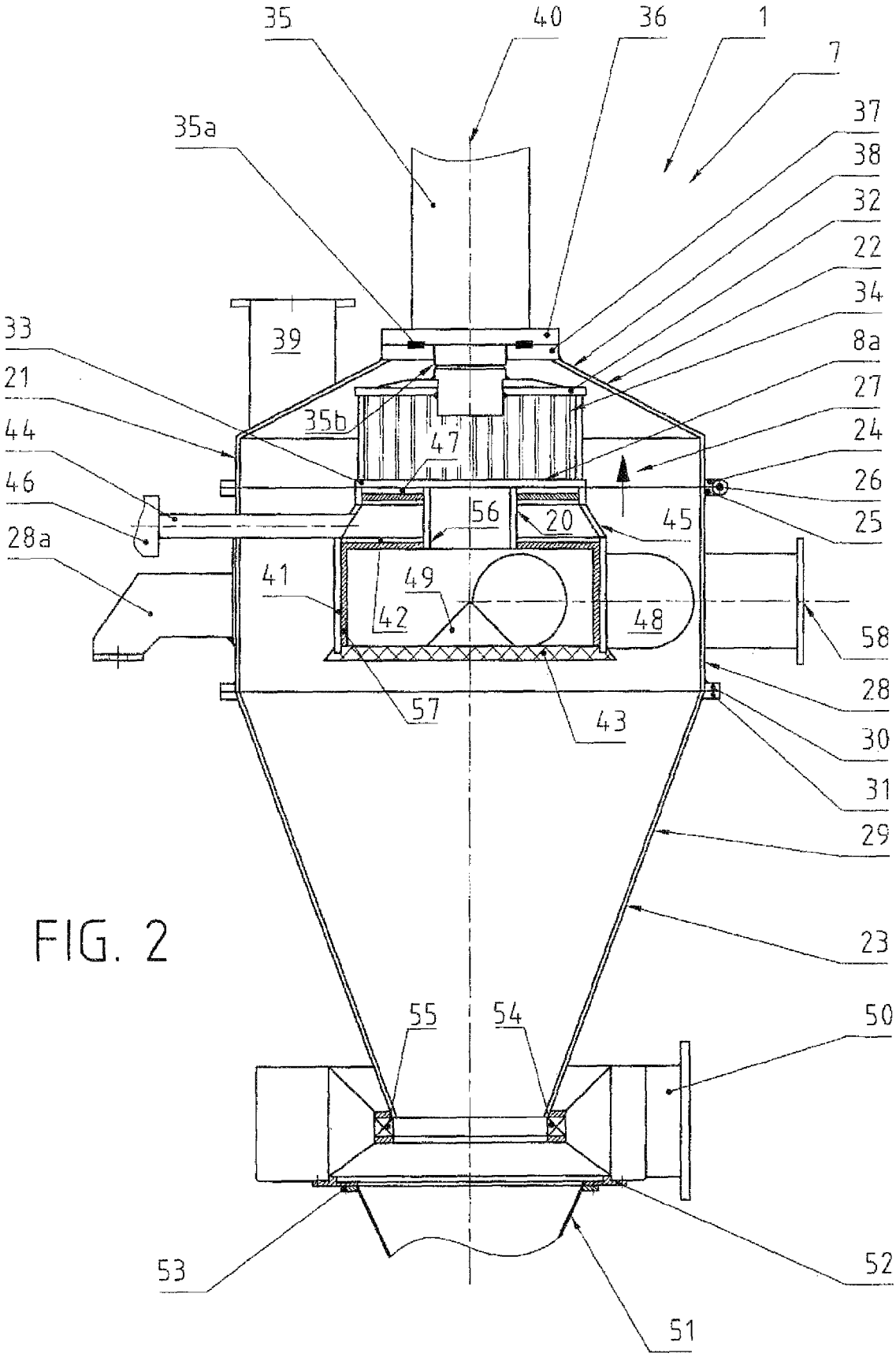
FIG. 2 shows an exemplary embodiment of an air classifier of a jet mill in vertical arrangement and as schematic centre longitudinal section, wherein the outlet pipe for the mixture of classifying air and solid particles are associated with the classifying wheel.

With reference to FIGS. 2 and 3, further details and versions of exemplary embodiments of the jet mill 1 and its components are explained in the following.

As is evident from the schematic representation in FIG. 2 the jet mill 1 contains an integrated air classifier 7 which, for example in the case of designs of the jet mill 1 as fluidized bed jet mill or as high-density bed jet mill relates to a dynamic air classifier 7, which advantageously is arranged in the centre of the comminution chamber 3 of the jet mill 1. The target fineness of the comminution stock can be influenced as a function of the comminution gas volumetric flow and classifier rotational speed.

In the case of the air classifier 7 of the jet mill 1 according to FIG. 2 the entire vertical air classifier 7 is enclosed by a classifier housing 21 which substantially consists of the housing upper part 22 and the housing lower part 23. The housing upper part 22 and the housing lower part 23 are each provided with a circumferential flange 24 and 25 directed towards the outside at the upper and lower edge respectively. The two circumferential flanges 24, 25 in the installed or operating state of the air classifier 8 lie on top of each other and are fixed relative to each other through suitable means. Suitable means for fixing are for example screw connections (not shown). Clamps (not shown) or the like can also serve as detachable fastening means.

On practically any point of the flange circumference both circumferential flanges 24 and 25 are joined to each other through a joint 26 so that the housing upper part 22 after the releasing of the flange fastening means can be swiveled upwards in the direction of the arrow 27 relative to the housing lower part 23 and the housing upper part 22 and the housing lower part 23 become accessible from below and above respectively. The housing lower part 23 itself is embodied in two parts and substantially consists of the cylindrical classifying chamber housing 28 with a circumferential flange 25 on its upper open end and a discharge cone 29 which tapers cone-shaped towards the bottom. The discharge cone 29 and the classifying chamber housing 28 lie on top of each other with flanges 30, 31 at the upper and lower end and the two flanges 30, 31 of the discharge cone 29 and the classifying chamber housing 28 are connected with each other through detachable fastening means (not shown) like the circumferential flanges 24, 25. The classifier housing 21 so put together is suspended on support arms 28*a*, of which a plurality is distributed preferably evenly spaced about the circumference of the classifier or compressor housing 21 of the air classifier 7 of the jet mill 1 and which act on the cylindrical classifying chamber housing 28.

A substantial part of the housing installations of the air classifier 7 again is the classifying wheel 8 with an upper covering disc 32, with a lower outflow-sided covering disc 33 axially spaced thereto and with vanes 34 with a practical contour arranged between the outer edges of the two covering discs 32 and 33 permanently joined with the latter and evenly distributed about the circumference of the classifying wheel 8. With this air classifier 7 the drive of the classifying wheel 8 is brought about via the upper covering disc 32 while the lower covering disc 33 is the outflow-sided covering disc. The bearing of the classifying wheel 8 comprises a classifying wheel shaft 35 forcibly driven in a practical manner which with the upper end is led out of the classifier housing 21 and with its lower end carries the classifying wheel 8 within the classifier housing 21 in a cantilever mounting in a rotationally fixed manner. The leading-out of the classifying wheel shaft 35 from the classifier housing 21 takes place in a pair of machined plates 36, 37 which close off the classifier housing 21 at the upper end of a housing end section 38 which runs upwards truncation of a cone-like guide the classifying wheel shaft 35 and seal this shaft penetration without obstructing the rotational movements of the classifying wheel shaft 35. Practically the upper plate 36 can be assigned to the classifying wheel shaft 35 as flange in a rotationally fixed manner and be supported rotatably on the lower plate 37 via rotary bearings 35*a*, which in turn are assigned to a housing end section 38. The lower side of the outflow-sided covering disc 33 lies in the common plain between the circumferential flanges 24 and 25, so that the classifying wheel 8 in its entirety is arranged within the foldable housing upper part 22. In the region of the conical housing end section 38 the housing upper part 22 additionally comprises a tube-like product charging connection 39 of the comminution stock feeder 4, whose longitudinal axis runs parallel to the rotational axis 40 of the classifying wheel 8 and its drive or classifying wheel shaft 35 and which, preferably far distant from this rotational axis 40 of the classifying wheel 8 and its drive or classifying wheel shaft 35, is arranged located radially outside on the housing upper part 22.

The classifier housing 21 accommodates the tube-like outlet connection 20 arranged on the same axis as the classifying wheel 8, which socket with its upper end lies closely below the outflow-sided covering disc 33 of the classifying wheel 8, however without being connected with the latter. An outlet chamber 41 is attached on the same axis to the lower end of the outlet connection 20 embodied as tube, which likewise is tube-shaped, however whose diameter is substantially larger than the diameter of the outlet connection 20 and in the present exemplary embodiment is at least double the size of the diameter of the outlet connection 20. At the transition between the outlet connection 20 and the outlet chamber 41*a* clear diameter jump is thus present. The outlet connection 20 is inserted in an upper covering plate 42 of the outlet chamber 41. At the bottom the outlet chamber 41 is closed through a removable lid 43. The construction unit of outlet connection 20 and outlet chamber 41 is held in a plurality of support arms 44 which, evenly distributed about the circumference of the construction unit star-shaped, with its inner ends in the region of the outlet connection 20, are permanently connected with the construction unit and with their outer ends are fastened to the classifier housing 21.

The outlet connection 20 is surrounded by a cone-shaped ring housing 45 whose lower larger outer diameter corresponds to at least the diameter of the outlet chamber 41 and its upper, smaller outer diameter at least to approximately the diameter of the classifying wheel 8. The support arms 44 end on the conical wall of the ring housing 45 and are permanently connected with said wall, which in turn is part of the construction unit of outlet connection 20 and outlet chamber 41.

The support arms 44 and the ring housing 45 are parts of a flushing air device (not shown), wherein the flushing air prevents the entering of matter from the inner space of the classifier housing 21 in the gap between the classifying wheel 8 or more precisely its lower covering disc 3 and the outlet connection 20. In order to let this flushing air get into the ring housing 45 and from there into the gap to be kept clear, the support arms 44 are embodied as pipes, with their outer end sections passed through the wall of the classifier housing 21 and connected to a flushing air source (not shown) via an intake filter 46. The ring housing 45 is closed off towards the top through a perforated plate 47 and the gap itself can be adjustable through an axially adjustable ring disc in the region between perforated plate 47 and lower covering disc 33 of the classifying wheel 8.

The outlet from the outlet chamber 41 is formed by a fines discharge pipe 48 which is introduced into the classifier housing 21 from the outside and connected to the outlet chamber 41 in tangential arrangement. The fines discharge pipe 48 is part of the product outlet 6. A deflection cone 49 serves as covering of the junction of the fines discharge pipe 48 with the outlet chamber 41.

On the lower end of the conical housing end section 38 a classifying air inlet spiral 50 and a coarse material discharge 51 are assigned to the housing end section 38 in horizontal arrangement. The direction of rotation of the classifying air inlet spiral 50 is opposed to the direction of rotation of the classifying wheel 8. The coarse material discharge 51 is removably assigned to the housing end section 38, wherein a flange 52 is assigned to the lower end of the housing end section 38 and a flange 53 to the upper end of the coarse material discharge 51 and both flanges 52 and 53 in turn are detachably connected with each other through known means when the air classifier 7 is ready for operation.

The dispersion zone to be configured is designated 54. Flanges machined on the inner edge (chamfered) for neat flow control and simple lining are designated 55.

Finally an interchangeable protective pipe 56 as wear part is still placed against the inner wall of the outlet connection 20 and a corresponding interchangeable protective pipe 57 can be placed against the inner wall of the outlet chamber 41.

At the start of the operation of the air classifier 7 in the operating state shown, classifying air is introduced into the air classifier 7 via the classifying air inlet spiral 50 subject to a pressure drop and with a suitably selected entry velocity. As a result of the introduction of the classifying air by means of spiral more preferably in connection with the conicity of the housing end section 38 the classifying air rises spiral-shaped upwards into the region of the classifying wheel 8. At the same time the "Product" of solid particles of various mass is charged into the classifying housing 21 via the product charging connection 39. The coarse material of this product, i.e. the particle component with greater mass reaches the region of the coarse material discharge 51 against the classifying air and is placed ready for further processing. The fines, i.e. the particle component with lesser mass is mixed with the classifying air, passes from the outside to the inside radially through the classifying wheel 8 into the outlet connection 20, into the outlet chamber 41 and finally into a fines outlet 58 via a fines outlet pipe 48, and from there into a filter in which the operating medium in form of a fluid, such as for example air, and fines are separated from each other. Coarser fines components are radially flung out of the classifying wheel 8 and admixed to the coarse material in order to leave the classifying housing 21 with the coarse material or to circulate in the classifier housing 21 until it has become fines of such a grain size that it is discharged with the classifying air.

As a result of the abrupt cross-sectional widening from the outlet connection 20 to the outlet chamber 41 a clear reduction of the flow velocity of the fines-air mixture takes place there. This mixture will thus reach the fines outlet 58 with a very low flow velocity through the outlet chamber 41 via the fines outlet pipe 48 and create only minor abrasion on the wall of the outlet chamber 41. For this reason the protective pipe 57 is only a highly precautionary measure. However, the high flow velocity in the classifying wheel 8 still prevails in the discharge socket 20 for the sake of a sound separating technique which is why the protective pipe 56 is more important than the protective pipe 57. Particularly significant is the diameter jump with a diameter widening at the transition from the outlet connection 20 to the outlet chamber 41.

As for the rest, the air classifier 7 through the sub-division of the classifying housing 21 in the manner described and the assignment of the classifier components to the individual part housings can be easily maintained and components that have become faulty can be replaced with relatively little effort and within short maintenance times.

While in the schematic representation of FIG. 2 the classifying wheel 8 with the two covering discs 32 and 33 and the vane ring 59 with the vanes 34 arranged between these is shown in the usual form with parallel and parallel-faced covering discs 32 and 33, the classifying wheel 8 for a further exemplary embodiment of the air classifier 7 of an advantageous further development is shown in FIG. 3.

This classifying wheel 8 according to FIG. 3 in addition to the vane ring 59 with the vanes 34 contains the upper covering disc 32 and the lower outflow-sided covering disc 33 axially spaced thereto and is rotatable about the rotation axis 40 and thus the longitudinal axis of the air classifier 7. The diametrical expansion of the classifying wheel 8 is perpendicularly to the rotation axis 40, i.e. to the longitudinal axis of the air classifier 7, regardless of whether the rotation axis 40 and thus the mentioned longitudinal axis stands vertically or runs horizontally. The lower outflow-sided covering disc 33 concentrically encloses the outlet connection 20. The vanes 34 are connected with the two covering disc 33 and 32. The two covering discs 32 and 33 now deviating from the prior art, are embodied conically namely preferentially in such a manner that the spacing of the upper covering disc 32 from the outflow-sided covering disc 33 from the ring 59 of the vanes 34 becomes greater towards the inside, i.e. towards the rotation axis 40, namely preferably continuously such as for example linearly or non-linearly, and with further preference so that the face of the cylinder shall subjected to the through-flow remains at least approximately constant for any radius between vane outlet edges and outlet connection 20. The outflow velocity that becomes lower with known solutions as a result of the diminishing radius remains at least approximately constant with this solution.

Except for the version of the embodiment of the upper covering disc 32 and the lower covering disc 33 explained above and in FIG. 3 it is also possible that only one of these two covering discs 32 or 33 are embodied conically in the explained manner and the other covering disc 33 or 32 is flat, as is the case in connection with the exemplary embodiment according to FIG. 2 for both covering discs 32 and 33. More preferably the shape of the non-parallel faced covering disc can be such that at least approximately so, that the face of the cylinder shell subjected to the through flow remains constant for any radius between vane outlet edges and outlet connection 20.

The following examples serve to illustrate and explain in more detail the invention, but do not restrict said invention in any manner.

Base Materials:

Silica 1:

Precipitated silicic acid which was produced as follows was used as base material to be comminuted:

The water glass used at various points in the following instruction for the manufacture of the Silica 1 and the sulphuric acid are characterized as follows:

Water glass: Density 1.348 kg/l, 27.0% by weight SiO2, 8.05% by weight Na2O

Sulphuric acid: Density 1.83 kg/l, 94% by weight

An 150 $m^3$ precipitation vessel with inclined base, MIG-inclined blade agitating system and Ekato fluid-shearing turbine is filled with 117 $m^3$ of water and 2.7 $m^3$ of water glass added. The ratio of water glass to water is set so that an alkali number of 7 is obtained. Following this, the content is heated to 90° C. Once the temperature is reached, water glass with a dosing rate of 10.2 $m^3$/h and sulphuric acid with a dosing rate of 1.55 $m^3$/h are added simultaneously for the period of 75 mins. once the temperature has been reached. After this, water glass with a dosing rate of 18.8 $m^3$/h and sulphuric acid with a dosing rate of 1.55 $m^3$/h are added simultaneously for a further 75 mins. with agitation. During the entire addition time the dosing rate of the sulphuric acid is corrected if required so that during this period of time an alkali number of 7 is maintained.

After this, water glass dosing is switched off. Following this, sulphuric is added within 15 min. so that a pH-value of 8.5 is obtained thereafter. With this pH-value the suspension is agitated (=aged) for the duration of 30 mins. Thereafter the pH-value of the suspension is set to 3.8 through addition of sulphuric acid within approximately 12 mins. During the precipitation, the ageing and the acidification the temperature of the precipitation suspension is kept at 90° C. The suspension obtained is filtered with a diaphragm filter press and the filter cake washed with de-ionised water until a conductivity of <10 mS/cm can be detected in the washing water. The filter cake present then has a solid content of <25%. The filter cake is dried in a spin-flash drier.

The data of Silica 1 is stated in Table 1.

Hydrogel-Production

A silica gel (=Hydrolgel) is produced of water glass (density 1.348 kg/l, 27.0% by weight SiO2, 8.05% by weight Na2O) and 45% sulphuric acid. To do so, 45% by weight of sulphuric acid and sodium water glass are intensively intermixed so that a reactant ratio corresponding to an excess of acid (0.25 N) and an SiO2 concentration of 18.5% by weight is obtained. The Hydrogel so created is stored overnight (approx. 12 h) and then broken to a particle size of approx. 1 cm. It is washed with de-ionised water at 30-50° C. until the conductivity of the washing water is below 5 mS/cm.

Silica 2 (Hydrogel)

The Hydrogel produced as described above is aged for 10-12 hours subject to the addition of ammonia at pH 9 and 80° C. and then set to pH 3 using 45% by weight of sulphuric acid. The Hydrogel then has a solid content of 34-35%. After this it is coarsely ground in a pin mill (Alpine Type 160Z) to a particle size of approx. 150 μm. The Hydrogel has a residual moisture of 67%.

The data of Silica 2 is stated in Table 1.

Silica 3*a:*

Silica 2 is dried by means of spin flash drier (Anhydro A/S, APV, Type SFD47, T in=350° C., T out=130° C.) so that following drying it has a final moisture of approx. 2%.

The data of Silica 3*a* is state in Table 1.

Silica 3*b:*

The Hydrogel produced as described above is further subjected to washing at approx. 80° C. until the conductivity of the washing water is below 2 mS/cm and in the circulating air drying cabinet (Fresenberger POH1600.200) dried to a residual moisture of <5% at 160° C. In order to achieve uniform dosing behavior and comminution result, the xerogel is pre-reduced (Alpine AFG 200) to a particle size<100 μm.

The data of Silica 3*b* is stated in Table 1.

Silica 3*c:*

The Hydrogel produced as described above subject to the addition of ammonia is aged at pH 9 and 80° C. for 4 hours, then set to approx. pH 3 with 45% by weight of sulphuric acid and dried in the circulating air drying cabinet (Fresenberger POH 1600.200) at 160° C. to a residual moisture of <5%. In order to achieve a more uniform dosing behavior and comminution result, the xerogel is pre-reduced to a particle size<100 μm (Alpine AFG 200).

The data of Silica 3*c* is stated in Table 1.

TABLE 1

Physical-chemical data of the uncomminuted base materials

| | Silica 1 | Silica 2 | Silica 3a | Silica 3b | Silica 3c |
|---|---|---|---|---|---|
| Particle size distribution by means of laser diffraction (Horiba LA 920) | | | | | |
| $d_{50}$ [μm] | 22.3 | n.d. | n.d. | n.d | n.d. |
| $d_{99}$ [μm] | 85.1 | n.d. | n.d. | n.d. | n.d. |
| $d_{10}$ [μm] | 8.8 | n.d. | n.d. | n.d. | n.d. |
| Particle size distribution by means of sieve analysis | | | | | |
| >250 μm % | n.d. | n.d. | n.d. | 0.0 | 0.2 |
| >125 μm % | n.d. | n.d. | n.d. | 1.06 | 2.8 |
| >63 μm % | n.d. | n.d. | n.d. | 43.6 | 57.8 |
| >45 μm % | n.d. | n.d. | n.d. | 44.0 | 36.0 |
| <45 μm % | n.d. | n.d. | n.d. | 10.8 | 2.9 |
| Moisture % | 4.8 | 67 | <3 | <5 | <5% |
| pH-value | 6.7 | n.d. | n.d. | n.d. | n.d. |

n.d. = not determined

EXAMPLES 1-3

Comminution According to the Invention

To prepare the actual comminution with superheated steam a fluidized bed counterflow jet mill according to FIGS. 1, 2 and 3 is initially heated up to a mill outlet temperature of approximately 105° C. by way of two heating nozzles 5*a* (of which only one is shown in FIG. 1) which are supplied with hot compressed air of 10 bar and 160° C.

To separate the comminution stock a filter system is connected downstream of the mill (not shown in FIG. 1) whose filter housing is heated indirectly in the lower third by way of heating coils using 6 bar saturated steam likewise to prevent condensation. All apparatus surfaces in the region of the mill, of the separation filter, and the supply lines for steam and hot compressed air are specially insulated.

Once the desired heating-up temperature is reached the supply of the heating nozzles with hot compressed air is switched off and admission of superheated steam (38 bar (abs), 330° C.) to the three comminution nozzles started.

To protect the filter means used in the separation filter and to set a defined residual water content of the comminution stock from preferably 2 to 6%, water during the starting phase and during comminution is injected into the comminution chamber of the mill via a compressed air-operated two-substance nozzle as a function of the mill outlet temperature.

Product charging commences when the relevant process parameters (see Table 2) are constant. The feed quantity is controlled as a function of the classifier flow that results. The classifier flow controls the feed quantity in such a manner that approximately 70% of the rated flow cannot be exceeded.

A speed-controlled cell wheel acts as an input organ here which doses the charge material from a storage vessel via a cycle lock that serves as barometric closure into the pressurised comminution chamber.

The coarse material is reduced in the expanding steam jets (comminution gas). Jointly with the expanded comminution gas the product particles rise in the centre of the mill vessel to the classifying wheel. Depending on the said classifier speed and comminution steam quantity (see Table 1) the particles which have adequate fineness reach the fines outlet with the comminution steam and from there the separating system connected downstream, while particles which are too coarse are returned into the comminution zone and once more subjected to a reduction. The discharge of the separated fines from the separating filter and the subsequent ensilation and packaging is performed by means of cell wheel lock.

The comminution pressure of the comminution gas that prevails at the comminution nozzles and the comminution gas quantity resulting therefore in conjunction with the speed of the dynamic vane wheel classifier determine the fineness of the grain distribution function as well as the oversize limit.

The relevant process parameters can be taken from Table 2, the product parameters from Table 3:

TABLE 2

| Example 1 | Example 2 | Example 3a | Example 3b | Example 3c |
|---|---|---|---|---|
| Base material: | | | | |
| Silica 1 | Silica 2 | Silica 3a | Silica 3b | Silica 3c |
| Nozzle diameter [mm]: | | | | |
| 2.5 | 2.5 | 2.5 | 2.5 | 2.5 |
| Nozzle type: | | | | |
| Laval | Laval | Laval | Laval | Laval |
| Quantity [units]: | | | | |
| 3 | 3 | 3 | 3 | 3 |

TABLE 2-continued

| Example 1 | Example 2 | Example 3a | Example 3b | Example 3c |
|---|---|---|---|---|
| Mill inside pressure [bar abs.]: | | | | |
| 1.306 | 1.305 | 1.305 | 1.304 | 1.305 |
| Inlet pressure [bar abs.]: | | | | |
| 37.9 | 37.5 | 36.9 | 37.0 | 37.0 |
| Inlet temperature [° C.]: | | | | |
| 325 | 284 | 327 | 324 | 326 |
| Mill outlet temperature [° C.]: | | | | |
| 149.8 | 117 | 140.3 | 140.1 | 139.7 |
| Classifier rotational speed [$min^{-1}$]: | | | | |
| 5619 | 5500 | 5491 | 5497 | 5516 |
| Classifier flow [A %]: | | | | |
| 54.5 | 53.9 | 60.2 | 56.0 | 56.5 |
| Immersion pipe diameter [mm]: | | | | |
| 100 | 100 | 100 | 100 | 100 |

TABLE 3

| | Example 1 | Example 2 | Example 3a | Example 3b | Example 3c |
|---|---|---|---|---|---|
| $d_{50}$ [1)] | 125 | 106 | 136 | 140 | 89 |
| $d_{90}$ [1)] | 275 | 175 | 275 | 250 | 200 |
| $d_{99}$ [1)] | 525 | 300 | 575 | 850 | 625 |
| BET-surface area $m^2/g$: | | | | | |
| | 122 | 354 | 345 | 539 | 421 |
| N2 pore volume ml/g: | | | | | |
| | n.d. | 1.51 | 1.77 | 0.36 | 0.93 |
| Mean pore size nm: | | | | | |
| | n.d. | 17.1 | 20.5 | 2.7 | 8.8 |
| DBP (water-free) g/100 g: | | | | | |
| | 235 | 293 | 306 | 124 | 202 |
| Tamped density g/l: | | | | | |
| | 42 | 39 | 36 | 224 | 96 |
| Drying loss %: | | | | | |
| | 4.4 | 6.1 | 5.5 | 6.3 | 6.4 |

[1)] Particle size distribution determined by means of transmission electron microscopy (TEM) and image analysis and values stated in nm.

In the description and in the drawing the invention by means of the exemplary embodiments is merely shown exemplarily and not restricted to these, but comprises all variations, modifications, substitutions and combinations, which the person skilled in the art can deduce from the present documents, which he or she can combine with his or her expert knowledge as well as the state of the art. More preferably all individual features and configuration possibilities of the invention and its embodiment versions are combinable.

What is claimed is:

1. A method for generating fine particles comprising:

using a jet mill having an integrated dynamic air classifier, the integrated dynamic air classifier having a classifying rotor or wheel and an inner amplification ratio R, wherein the rotational speed of the classifying rotor or wheel and the inner amplification ratio R are so selected, set or controlled that the circumferential velocity of an operating medium at an immersion pipe or outlet connection assigned to the classifying rotor or wheel reaches up to 0.8 times the velocity of sound of the operating medium.

2. A method for generating fine particles comprising:

using a jet mill having an integrated dynamic air classifier, the integrated dynamic air classifier having a classifying rotor or wheel and an inner amplification ratio R, wherein the rotational speed of the classifying rotor or wheel and the inner amplification ratio R are so selected, set or controlled that the circumferential velocity of the operating medium at an immersion pipe or outlet connection reaches up to 0.7 times the velocity of sound of the operating medium.

3. The method of claim 1, wherein the operating medium is a fluid, which has a higher velocity of sound than air (343 m/s).

4. The method of claim 1, wherein the operating medium is a fluid, which has a velocity of sound of at least 450 m/s.

5. The method of claim 1, wherein the operating medium is selected from a group consisting of steam, hydrogen gas or helium gas.

* * * * *